US009643428B2

(12) United States Patent
Uryu et al.

(10) Patent No.: US 9,643,428 B2
(45) Date of Patent: May 9, 2017

(54) THERMAL PRINTER

(71) Applicant: FUJITSU COMPONENT LIMITED, Tokyo (JP)

(72) Inventors: Natsumi Uryu, Tokyo (JP); Hiroyuki Kataoka, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/090,816

(22) Filed: Apr. 5, 2016

(65) Prior Publication Data

US 2016/0297208 A1 Oct. 13, 2016

(30) Foreign Application Priority Data

Apr. 10, 2015 (JP) ..... 2015-080939

(51) Int. Cl.
*B41J 29/393* (2006.01)
*B41J 2/355* (2006.01)

(52) U.S. Cl.
CPC ..... *B41J 2/3555* (2013.01); *B41J 2/355* (2013.01)

(58) Field of Classification Search
CPC ..... B41J 2/21; B41J 2/28; B41J 2/2121; B41J 2/07; B41J 2/205; B41J 2/04563; B41J 2/04593; B41J 2/04581; B41J 11/0095; B41J 11/009; B41J 2/14153; B41J 11/008; B41J 11/42; B41J 2/04505; B41J 2/04541; B41J 2/0458; B41J 3/28; B41J 11/06
See application file for complete search history.

(56) References Cited

U.S. PATENT DOCUMENTS

| | | | | |
|---|---|---|---|---|
| 5,142,302 | A | 8/1992 | Kano | |
| 7,290,844 | B2 * | 11/2007 | Takahashi | B41J 29/393 347/14 |
| 8,144,365 | B2 * | 3/2012 | Kita | G03G 15/5029 347/19 |
| 8,960,839 | B1 | 2/2015 | Mantell et al. | |
| 2006/0158683 | A1 | 7/2006 | Gustafsson | |

FOREIGN PATENT DOCUMENTS

| | | |
|---|---|---|
| JP | S62-280055 | 12/1987 |
| JP | H04-220358 | 8/1992 |

* cited by examiner

*Primary Examiner* — Lamson Nguyen
(74) *Attorney, Agent, or Firm* — IPUSA, PLLC

(57) ABSTRACT

A thermal printer includes heating elements each of which generates heat according to an amount of energy applied thereto, an energy applier that applies energy to each of the heating elements, a memory that stores a gradation table where energy values are set for gradation levels based on a relationship between reflectances of a printed image and amounts of energy applied to the heating elements, and a controller that transfers control data corresponding to gradation levels of image data to the energy applier based on the gradation table to control the amounts of energy to be applied by the energy applier to each of the heating elements.

8 Claims, 14 Drawing Sheets

THERMAL PRINTER

CROSS-REFERENCE TO RELATED APPLICATION

The present application is based upon and claims the benefit of priority of Japanese Patent Application No. 2015-080939, filed on Apr. 10, 2015, the entire contents of which are incorporated herein by reference.

BACKGROUND OF THE INVENTION

1. Field of the Invention

An aspect of this disclosure relates to a thermal printer.

2. Description of the Related Art

A known thermal printer includes multiple heating elements that generate heat corresponding to the amounts of energy applied, and forms a multi-gradation image on a recording medium.

In such a thermal printer, for example, gradation levels are determined based on a relationship, which is indicated by FIG. 17, between the optical density of a printed image and the energy applied to the heating elements, such that differences in optical density between the gradation levels become substantially the same, and the amounts of energy applied to the heating elements are set for the respective gradation levels.

Also, Japanese Laid-Open Patent Publication No. 04-220358, for example, discloses a thermal printer where the amounts of energy applied to heating elements are determined based on linear approximation of the relationship between the optical density of a printed image in a medium density range and the applied energy, in order to reduce the processing load.

The relationship between the optical density and the reflectance indicating brightness of a printed image is represented by a formula below.

$$\text{Optical density} = -\log(\text{reflectance})$$

Accordingly, as illustrated by FIG. 18, the reflectance changes sharply in a low optical density range and changes gradually in a high optical density range. For this reason, even when the amounts of energy applied to heating elements are determined such that the optical density changes at a constant interval as illustrated by FIG. 17, changes in reflectance in a high density range may become small and the gradation reproducibility may become low.

FIGS. 19A and 19B illustrate exemplary printed images. FIG. 19A is a printed image printed by applying energy to heating elements at levels that are determined based on the relationship between the optical density and the energy illustrated by FIG. 17 such that changes in optical density between gradation levels become substantially the same. FIG. 19B is an image printed by applying energy to heating elements at levels that are determined based on linear approximation of the relationship between the optical density and the energy applied to the heating elements.

When the amounts of energy applied to heating elements are determined based on the optical density, the reflectance of a printed image in the low density range sharply changes, and gradations of the printed image in the high density range become indiscernible. This in turn may practically reduce the number of reproducible gradation levels.

SUMMARY OF THE INVENTION

In an aspect of this disclosure, there is provided a thermal printer that includes heating elements each of which generates heat according to an amount of energy applied thereto, an energy applier that applies energy to each of the heating elements, a memory that stores a gradation table where energy values are set for gradation levels based on a relationship between reflectances of a printed image and amounts of energy applied to the heating elements, and a controller that transfers control data corresponding to gradation levels of image data to the energy applier based on the gradation table to control the amounts of energy to be applied by the energy applier to each of the heating elements.

DESCRIPTION OF EMBODIMENTS

Figure 1:
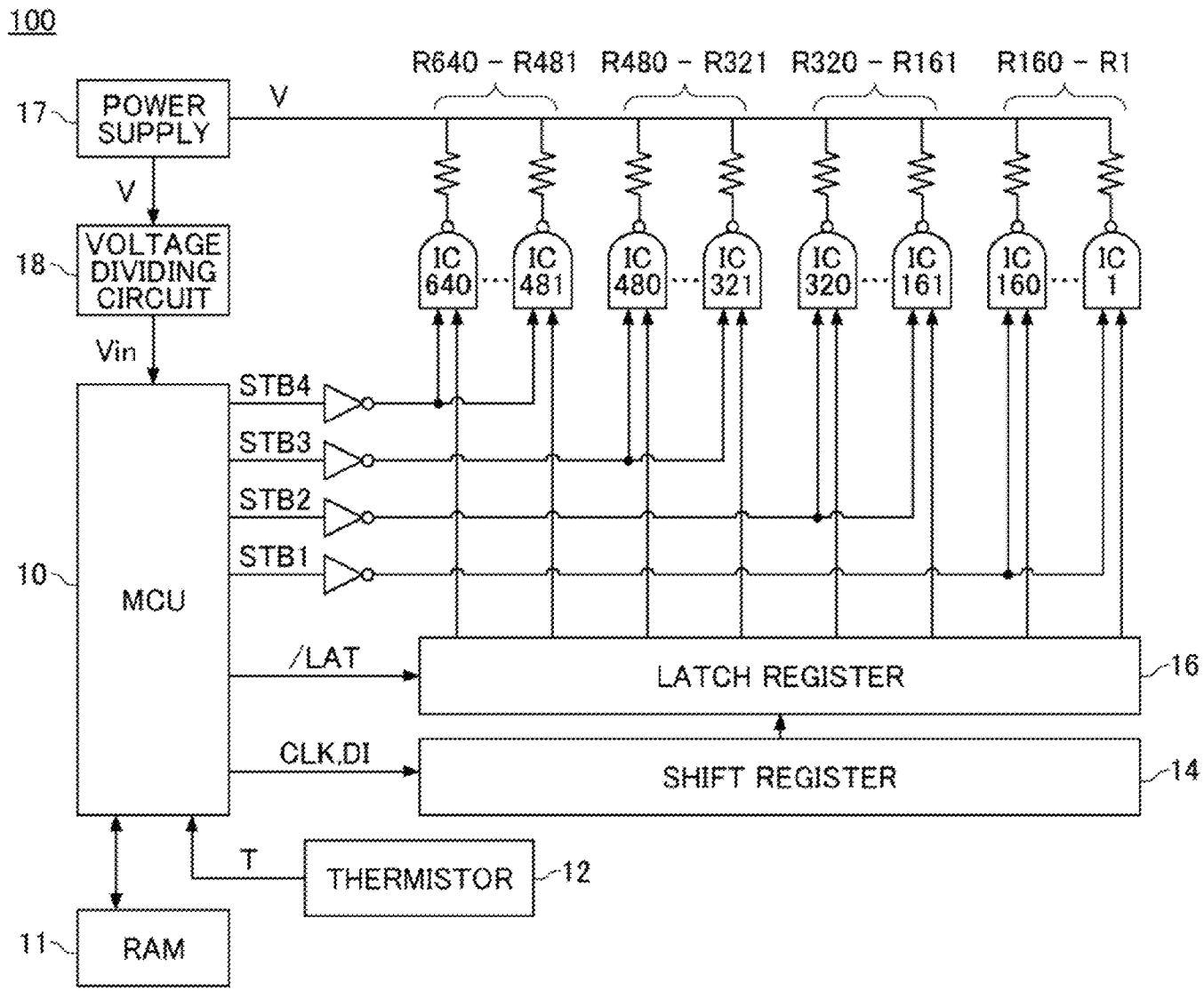
FIG. 1 is a drawing illustrating a thermal printer according to an embodiment.

Embodiments of the present invention are described below with reference to the accompanying drawings. The same reference number is assigned to the same components in the drawings, and repeated descriptions of those components may be omitted.

<Configuration of Thermal Printer>

FIG. 1 is a drawing illustrating an exemplary configuration of a thermal printer 100 according to an embodiment.

As illustrated by FIG. 1, the thermal printer 100 includes a micro control unit (MCU) 10, a random access memory (RAM) 11, a thermistor 12, a shift register 14, a latch register 16, a power supply 17, a voltage dividing circuit 18, integrated circuits (IC) 1-640 (may collectively referred to as "ICs"), and heating elements R1-R640 (may collectively referred to as "heating elements R").

The heating elements R are provided in a thermal head and arranged in a line along the main scanning direction. The respective heating elements R1-R640 generate heat corresponding to the levels of applied energy to heat a recording medium such as thermal paper and form an image on the recording medium.

The heating elements R are grouped into printing blocks corresponding to print areas, and each of the printing blocks are separately controlled. In the present embodiment, the heating elements R are grouped into four printing blocks each including 160 heating elements: heating elements R1-R160, heating elements R161-R320, heating elements R321-R480, and heating elements R481-R640. The number of heating elements and printing blocks are not limited to this example.

The MCU 10 is an example of a controller. The MCU 10 sets energy values representing the amounts of energy applied to each of the heating elements R based on the gradation levels of an image to be printed, and sends various signals to the shift register 14, the latch register 16, and the ICs. The shift register 14, the latch register 16, the ICs, and the power supply 17 constitute an energy applier for applying energy to the heating elements R.

The MCU 10 generates a DI signal for controlling the heating elements R based on image data input to the thermal printer 100 and a gradation table stored in the RAM 11, and sends the generated DI signal to the shift register 14 via a clock synchronous serial communication. Also, after transmitting the DI signal for one print line to the shift register 14, the MCU 10 sends a /LAT signal to the latch register 16 to cause the latch register 16 to latch data in the shift register 14.

The RAM 11 is an example of a memory, and stores a gradation table that contains energy values corresponding to gradation levels.

The shift register 14 stores 640-bit data, and includes data areas corresponding to the heating elements R. Each bit of the shift register 14 corresponds to one of the heating elements R1-R640. For example, bit 0 corresponds to the heating element R1, and bit 639 corresponds to the heating element R640. The data stored in the shift register 14 is used to control the corresponding heating elements R1-R640. When a bit is 1, the corresponding heating element is turned on; and when a bit is 0, the corresponding heating element is turned off.

Similarly to the shift register 14, the latch register 16 includes data areas corresponding to the heating elements R. The latch register 16 receives the /LAT signal from the MCU 10, and latches signals sent from the shift register 14. The signals latched by the latch register 16 are input to input terminals of the ICs.

Each of the ICs corresponds to and is connected to one of the heating elements R1-R640, respectively. Each of the ICs is turned on and off by an STB signal. When an IC receives a signal indicating 1 from the latch register 16 and receives an STB signal from the MCU 10, the IC supplies power to the corresponding heating element. Power is supplied to the heating element while the corresponding IC is ON. The power-supply period of each heating element is controlled by a period in which the STB signal is on. The amount of energy supplied to a heating element increases as the power-supply period increases.

The MCU 10 sends an STB signal for each of the printing blocks. In the present embodiment, the MCU 10 sends an STB1 signal to the ICs 1-160, an STB2 signal to the ICs 161-320, an STB3 signal to the ICs 321-480, and an STB4 signal to the ICs 481-640, to separately control each of the printing blocks.

The power supply 17 is connected to the heating elements R, and applies a voltage V to the heating elements R. The MCU 10 obtains the voltage V applied by the power supply 17 to the heating elements R based on a voltage Vin obtained by the voltage dividing circuit 18 by dividing the voltage V. The thermistor 12 is an example of a temperature detector, and measures a temperature of the thermal head where the heating elements R are provided, and sends a measurement T of the temperature to the MCU 10.

<Gradation Table>

A gradation table for controlling the energy applied to the heating elements R is described.

Figure 2:
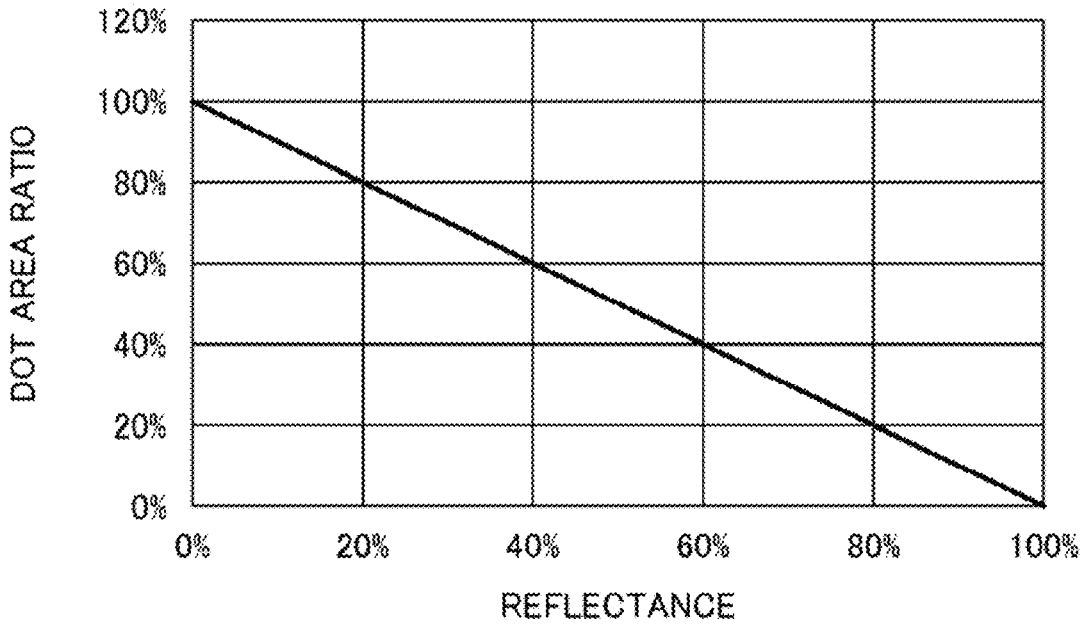
FIG. 2 is a graph illustrating a relationship between a dot area ratio and a reflectance of an image.

To reproduce smooth gradations of an image, a grayscale between white and black is divided based on reflectances. As illustrated by FIG. 2, the reflectance is proportional to the dot area ratio. The relationship between the dot area ratio and the optical density is represented by a Murray-Davies equation. When $D_0$ indicates the density of paper, $D_s$ indicates a saturation density, and $D_t$ indicates a printed-area density, dot area ratio A is represented by a formula (1) below.

$$A[\%] = 100 \times \frac{(1 - 10^{-(D_t - D_0)})}{(1 - 10^{-(D_s - D_0)})} \quad (1)$$

Figure 3:
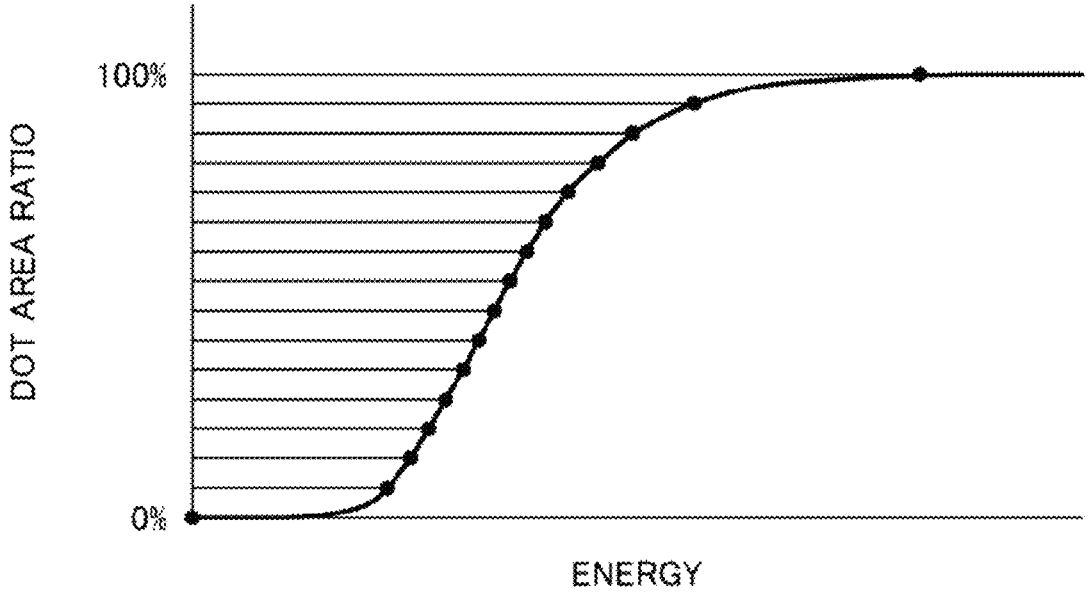
FIG. 3 is a graph illustrating a relationship between a dot area ratio of an image and energy applied to heating elements.

In the present embodiment, gradation levels are determined based on a relationship between the energy applied to the heating elements and the dot area ratio of an image such that changes or differences in the dot area ratio between the gradation levels become substantially the same, and energy values corresponding to the gradation levels are set. FIG. 3 is an example of 16 gradation levels obtained by dividing a range between a dot area ratio of 0% (white) and a dot area ratio of 100% (black) into 15 equal parts, and illustrates energy values corresponding to the gradation levels.

Figure 4:
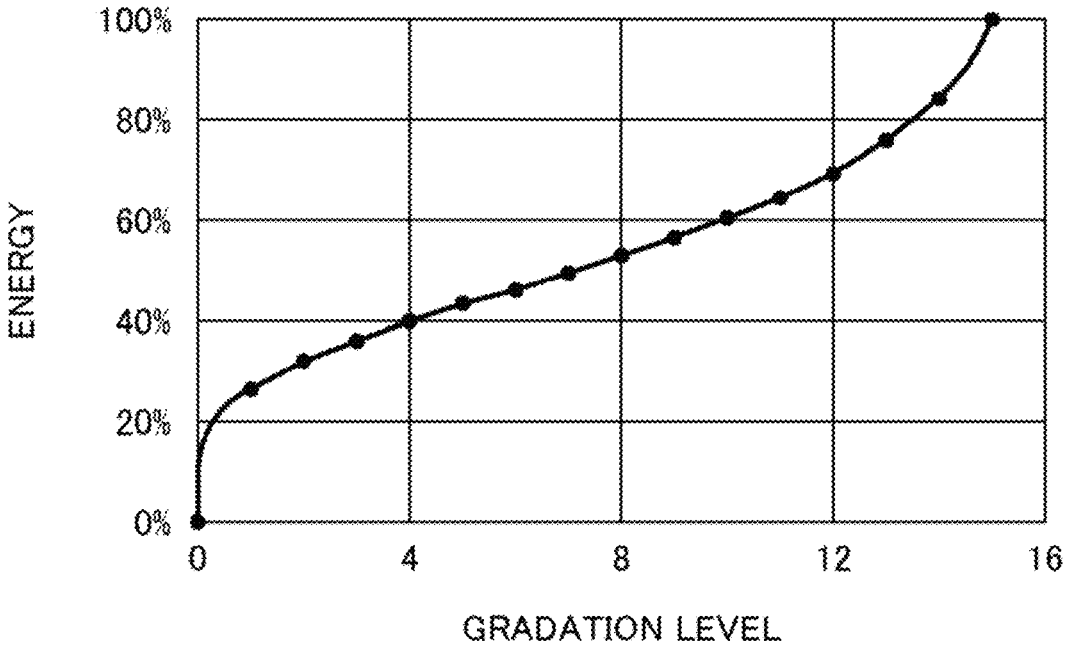
FIG. 4 is a graph illustrating a relationship between a gradation level and energy applied to heating elements.

FIG. 4 is a graph illustrating an exemplary relationship between 16 gradation levels and energy values derived from FIG. 3. In FIG. 4, an energy value of 100% corresponds to the energy value at the dot area ratio of 100% (the maximum gradation level) in FIG. 3. In the thermal printer 100, energy values representing the amounts of energy applied to the heating elements are determined for respective gradation levels based on the relationship between the dot area ratio of an image and the applied energy, and the determined energy values are stored in the RAM 11 as a gradation table. Table 1 is an example of the gradation table.

TABLE 1

| GRADATION LEVEL | ENERGY |
|---|---|
| 0 | 0.0% |
| 1 | 25.9% |

TABLE 1-continued

| GRADATION LEVEL | ENERGY |
|---|---|
| 2 | 31.3% |
| 3 | 35.3% |
| 4 | 38.8% |
| 5 | 42.0% |
| 6 | 45.2% |
| 7 | 48.4% |
| 8 | 51.7% |
| 9 | 55.1% |
| 10 | 58.9% |
| 11 | 63.3% |
| 12 | 68.4% |
| 13 | 74.8% |
| 14 | 83.7% |
| 15 | 100.0% |

Storing energy values for respective gradation levels in advance as a gradation table eliminates the need to calculate an energy value corresponding to a desired gradation level during a printing process based on a relationship between gradation levels and energy values.

Table 1 includes gradation levels 0-15 used to print a 16-gradation-level image. However, depending on the number of gradation levels of image data to be printed, a different gradation table including, for example, 4 gradation levels or 32 gradation levels may be stored in the RAM 11. Also, multiple gradation tables of different gradation levels may be stored in the RAM 11. Table 2 is an example of a gradation table including 4 gradation levels, and Table 3 is an example of a gradation table including 32 gradation levels.

TABLE 2

| GRADATION LEVEL | ENERGY |
|---|---|
| 0 | 0.0% |
| 1 | 42.0% |
| 2 | 59.0% |
| 3 | 100.0% |

TABLE 3

| GRADATION LEVEL | ENERGY |
|---|---|
| 0 | 0.0% |
| 1 | 21.7% |
| 2 | 25.7% |
| 3 | 28.6% |
| 4 | 31.0% |
| 5 | 33.0% |
| 6 | 34.9% |
| 7 | 36.7% |
| 8 | 38.3% |
| 9 | 39.9% |
| 10 | 41.5% |
| 11 | 43.0% |
| 12 | 44.6% |
| 13 | 46.1% |
| 14 | 47.6% |
| 15 | 49.2% |
| 16 | 50.8% |
| 17 | 52.4% |
| 18 | 54.1% |
| 19 | 55.9% |
| 20 | 57.7% |
| 21 | 59.6% |
| 22 | 61.7% |

TABLE 3-continued

| GRADATION LEVEL | ENERGY |
|---|---|
| 23 | 63.9% |
| 24 | 66.3% |
| 25 | 68.9% |
| 26 | 71.9% |
| 27 | 75.3% |
| 28 | 79.2% |
| 29 | 84.1% |
| 30 | 90.5% |
| 31 | 100.0% |

When printing image data of 16 gradation levels, the MCU 10 sets the amounts of energy to be applied to each of the heating elements R based on Table 1. The MCU 10 controls the amount of energy applied to each of the heating elements R by changing the time period for which power is supplied to each of the heating elements R.

Figure 5A:
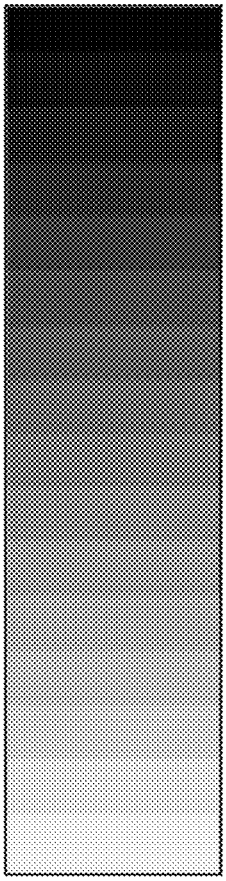
FIGS. 5A through 5C are examples of original image data and printed images.
Figure 5B:
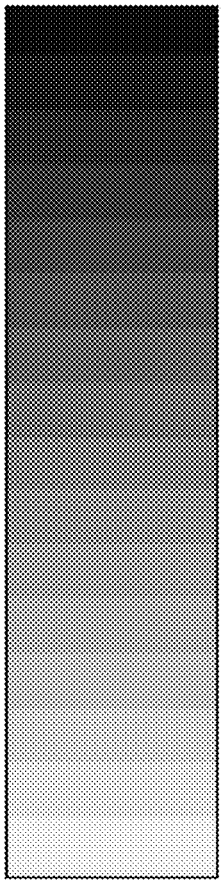

FIGS. 5A through 50 are examples of original image data and printed images. FIG. 5A illustrates original image data input to the thermal printer 100. The original image data has 16 gradation levels that are proportional to the dot area ratio. FIG. 5B is a printed image obtained by printing the original image data of FIG. 5A based on the gradation table of Table 1.

As indicated by FIG. 5B, by setting the amounts of energy applied to the heating elements R based on the dot area ratio, gradations in the high density range become clear and gradations of the original image data from the low density range to the high density range can be reproduced. Also in FIG. 5B, differences in reflectance between the gradation levels are substantially the same, and smooth gradations are reproduced. Thus, a high-quality image with excellent reproduction of gradations is obtained.

Figure 6:
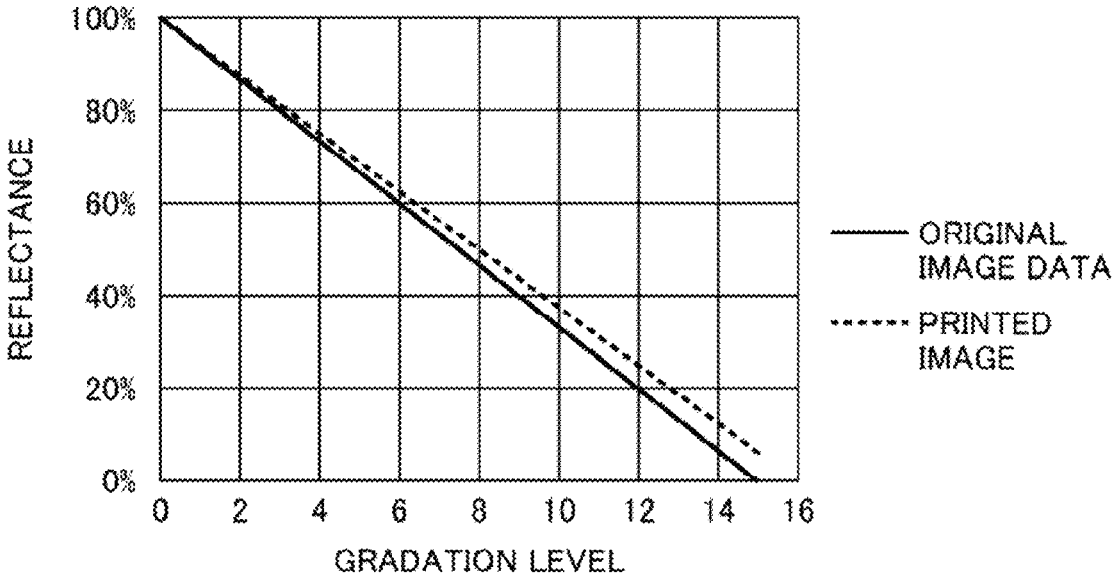
FIG. 6 is a graph illustrating a relationship between a gradation level and a reflectance in each of original image data and a printed image.

FIG. 6 is a graph illustrating a relationship between the gradation level and the reflectance in each of the original image data of FIG. 5A and the printed image of FIG. 5B. Here, assuming that the reflectance of a black image (gradation level 15) is 1%, the optical density is 2.00. However, the optical density of a black color in an actually-printed image does not reach 2.00. In FIG. 6 where the saturation density is 1.15, the reflectance of the black area becomes 7%. Therefore, it is assumed that a reflectance of 7% corresponds to a dot area ratio of 100% in FIG. 6.

Also, as indicated in FIG. 6, the reflectances of the printed image are slightly higher than the reflectances of the original image data at other gradation levels. For this reason, printing may be performed using a gradation table where energy values for respective gradation levels are set such that the reflectance of the printed image at each gradation level equals the reflectance of the original image data within a range of reflectance that is reproducible on a recording medium.

Figure 7:
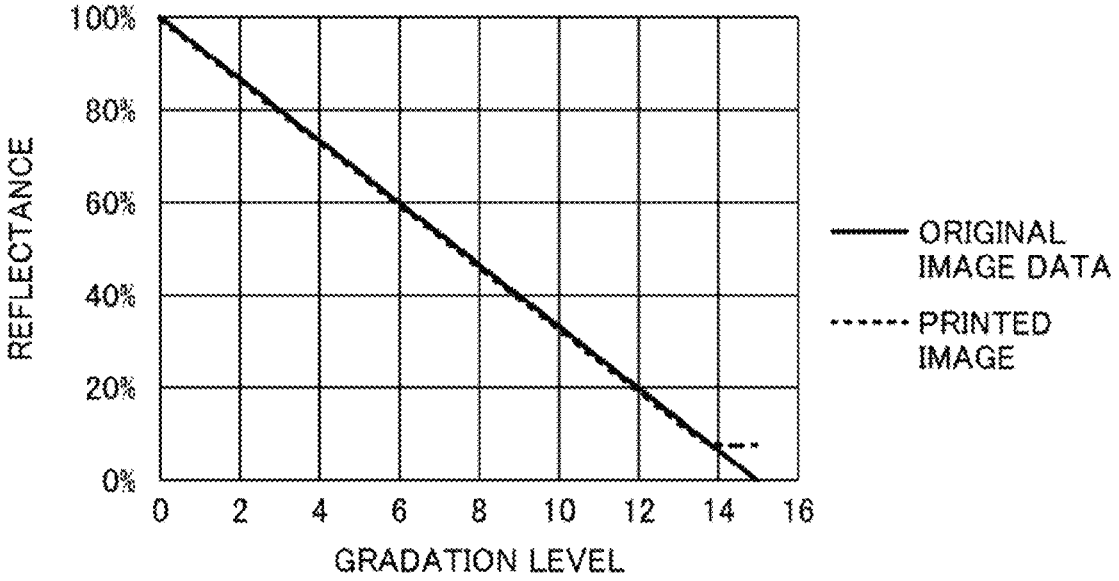
FIG. 7 is a graph illustrating a relationship between a gradation level and a reflectance in each of original image data and a printed image.
Figure 8:
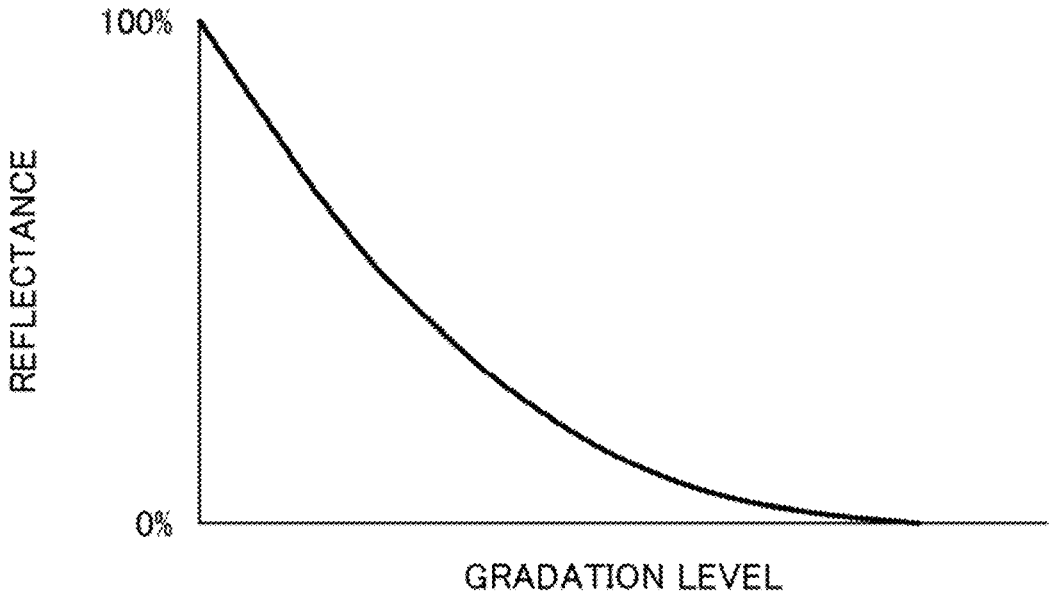
FIG. 8 is a graph illustrating a relationship between a gradation level and a reflectance.

FIG. 7 is a graph illustrating a relationship between the gradation level and the reflectance in a case where such a gradation table is used. In FIG. 7, although the reflectance (7%) of the printed image is different from the reflectance of the original image data at gradation level 15, the reflectance of the printed image and the reflectance of the original image data are substantially the same at gradation levels 0 through 14. In this case, the gradation table stores energy values corresponding to the reflectances in FIG. 7 in association with the gradation levels.

Figure 5C:
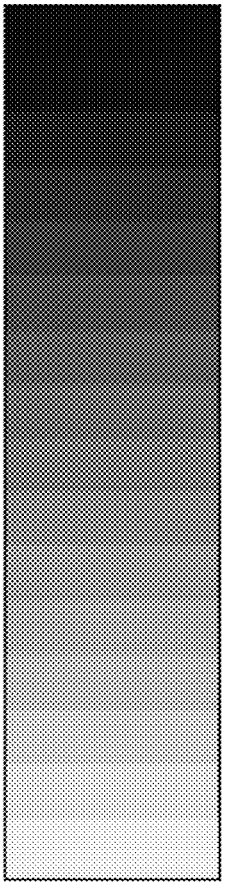

By using a gradation table where energy values are set such that the reflectance of original image data matches the reflectance of a printed image as in FIG. 7, an image can be printed such that the reflectance of the image matches the reflectance of its original image data at each of gradation levels 0 through 14. FIG. 5C is an example of a printed image printed using this type of gradation table (corrected gradation table).

As described above, by using the gradation table of Table 1 for printing, the gradation reproducibility of a printed image at gradation levels 0 through 15 can be improved. Also, by using a corrected gradation table, an image can be printed such that the reflectance of the printed image at each gradation level equals the reflectance of original image data within a range of reflectance that is reproducible on a recording medium.

The thermal printer 100 may be configured to store multiple gradation tables in the RAM 11, and to allow a user to select one of the gradation tables. The user can print an image with desired gradation characteristics by selecting a gradation table suitable for the image.

The RAM 11 may store gradation tables with different numbers of gradation levels as exemplified by Tables 1-3, and/or gradation tables where the same number of gradation levels are defined but different energy values are specified for the gradation levels. Also, RAM 11 may store a gradation table where energy values are set based on the relationship between the gradation level and the reflectance of an image expressed by a logarithmic function (FIG. 8) like the relationship between the Munsell value and the reflectance, and gradations are easily recognizable by human eyes. The MCU 10 controls the energy applied to the heating elements R based on a gradation table selected by a user.

<Data Transfer>

Next, a method of transferring control data for turning on and off the heating elements R is described.

The MCU 10 transfers control data for controlling the heating elements R to the shift register 14 so that energy corresponding to the gradation levels is applied to the heating elements R.

For example, when printing a 16-gradation-level image by using Table 1, the MCU 10 transfers control data corresponding to gradation levels 1 through for 15 times for each print line, and energy corresponding to gradation levels is applied to the respective heating elements R.

However, as control data is transferred 15 times for each print line, a data transfer time for each line becomes 128 p sec when the data transfer rate of the MCU 10 is 5 MHz. Accordingly, when the resolution of image data is 200 dpi (8 dot/mm), the printing speed becomes 60 mm/sec.

In the thermal printer 100 of the present embodiment, the number of data transfer from the MCU 10 is reduced to improve the printing speed.

When energy levels 0 through 15 as indicated by Table 4 are set by dividing the energy range of 0% through 100% into 16 equal parts, a 16-gradation-level image can be printed by transferring control data only four times.

TABLE 4

| | DATA TRANSFER | | | | |
|---|---|---|---|---|---|
| ENERGY LEVEL | FIRST 53.3% | SECOND 26.7% | THIRD 13.3% | FOURTH 6.7% | ENERGY |
| 0 | OFF | OFF | OFF | OFF | 0.0% |
| 1 | OFF | OFF | OFF | ON | 6.7% |
| 2 | OFF | OFF | ON | OFF | 13.3% |
| 3 | OFF | OFF | ON | ON | 20.0% |
| 4 | OFF | ON | OFF | OFF | 26.7% |
| 5 | OFF | ON | OFF | ON | 33.3% |

TABLE 4-continued

| | DATA TRANSFER | | | | |
|---|---|---|---|---|---|
| ENERGY LEVEL | FIRST 53.3% | SECOND 26.7% | THIRD 13.3% | FOURTH 6.7% | ENERGY |
| 6 | OFF | ON | ON | OFF | 40.0% |
| 7 | OFF | ON | ON | ON | 46.7% |
| 8 | ON | OFF | OFF | OFF | 53.3% |
| 9 | ON | OFF | OFF | ON | 60.0% |
| 10 | ON | OFF | ON | OFF | 66.7% |
| 11 | ON | OFF | ON | ON | 73.3% |
| 12 | ON | ON | OFF | OFF | 80.0% |
| 13 | ON | ON | OFF | ON | 86.7% |
| 14 | ON | ON | ON | OFF | 93.3% |
| 15 | ON | ON | ON | ON | 100.0% |

The MCU 10 transfers control data four times to apply energy of the energy levels 0 through 15 corresponding to the gradation levels 0 through 15 to the heating elements R. The MCU 10 sends first control data corresponding to energy of 53.3% at the first time, sends second control data corresponding to 26.7% energy at the second time, sends third control data corresponding to 13.3% energy at the third time, and sends fourth control data corresponding to 6.7% energy at the fourth time.

If the heating element R1 is to print an image of gradation level 7, energy of 46.7% needs to be applied to the heating element R1. In this case, the MCU 10 sends the second control data, the third control data, and the fourth control data for the heating element R1 based on Table 4. As a result, a total of 46.7% energy (26.7%+13.3%+6.7%) is applied to the heating element R1.

Thus, energy corresponding to gradation levels can be applied to the heating elements R by transferring control data four times such that each of control data corresponds to different amounts of energy. The method described above can reduce the number of data transfer from the MCU 10 to the shift register 14 and enables high-speed printing.

In Table 1, the minimum difference between two energy values set for the gradation levels is 3.2%. To support the minimum difference of 3.2%, as indicated by Table 5, energy levels are set by dividing the energy range of 0% through 100% into 32 ($=2^5$) equal parts such that the energy difference between energy levels becomes about 3.2%.

TABLE 5

| ENERGY LEVEL | ENERGY |
|---|---|
| 0 | 0.0% |
| 1 | 3.2% |
| 2 | 6.5% |
| 3 | 9.7% |
| 4 | 12.9% |
| 5 | 16.1% |
| 6 | 19.4% |
| 7 | 22.6% |
| 8 | 25.8% |
| 9 | 29.0% |
| 10 | 32.3% |
| 11 | 35.5% |
| 12 | 38.7% |
| 13 | 41.9% |
| 14 | 45.2% |
| 15 | 48.4% |
| 16 | 51.6% |
| 17 | 54.8% |
| 18 | 58.1% |
| 19 | 61.3% |
| 20 | 64.5% |

TABLE 5-continued

| ENERGY LEVEL | ENERGY |
|---|---|
| 21 | 67.7% |
| 22 | 71.0% |
| 23 | 74.2% |
| 24 | 77.4% |
| 25 | 80.6% |
| 26 | 83.9% |
| 27 | 87.1% |
| 28 | 90.3% |
| 29 | 93.5% |

TABLE 5-continued

| ENERGY LEVEL | ENERGY |
|---|---|
| 30 | 96.8% |
| 31 | 100.0% |

With Table 6, the energy values corresponding to the gradation levels in Table 1 can be associated with energy levels in Table 5.

TABLE 6

| GRADATION LEVEL | ENERGY | ENERGY LEVEL |
|---|---|---|
| 0 | 0.0% | 0 |
| 1 | 25.9% | 8 |
| 2 | 31.3% | 10 |
| 3 | 35.3% | 11 |
| 4 | 38.8% | 12 |
| 5 | 42.0% | 13 |
| 6 | 45.2% | 14 |
| 7 | 48.4% | 15 |
| 8 | 51.7% | 16 |
| 9 | 55.1% | 17 |
| 10 | 58.9% | 18 |
| 11 | 63.3% | 20 |
| 12 | 68.4% | 21 |
| 13 | 74.8% | 23 |
| 14 | 83.7% | 26 |
| 15 | 100.0% | 31 |

For example, 25.9% energy corresponding to gradation level 1 in Table 1 is close to 25.8% energy corresponding to energy level 8 in Table 5, and can be associated with energy level 8 as illustrated in Table 6. Accordingly, a 16-gradation-level image can be printed by using energy values corresponding to the energy levels associated with the gradation levels.

When energy values corresponding to gradation levels in a gradation table are associated with 32 ($=2^5$) energy levels as described above, the MCU 10 can print a 16-gradation-level image by transferring control data five times for each print line. For example, the MCU 10 transfers control data five times based on Table 7 to apply energy corresponding to the gradation levels to the heating elements R.

TABLE 7

| | DATA TRANSFER | | | | | | |
|---|---|---|---|---|---|---|---|
| GRADATION LEVEL | FIRST 51.6% | SECOND 25.8% | THIRD 12.9% | FOURTH 6.5% | FIFTH 3.2% | ENERGY LEVEL | ENERGY |
| 0 | OFF | OFF | OFF | OFF | OFF | 0 | 0.0% |
| 1 | OFF | ON | OFF | OFF | OFF | 8 | 25.8% |
| 2 | OFF | ON | OFF | ON | OFF | 10 | 32.3% |
| 3 | OFF | ON | OFF | ON | ON | 11 | 35.5% |
| 4 | OFF | ON | ON | OFF | OFF | 12 | 38.7% |
| 5 | OFF | ON | ON | OFF | ON | 13 | 41.9% |
| 6 | OFF | ON | ON | ON | OFF | 14 | 45.2% |
| 7 | OFF | ON | ON | ON | ON | 15 | 48.4% |
| 8 | ON | OFF | OFF | OFF | OFF | 16 | 51.6% |
| 9 | ON | OFF | OFF | OFF | ON | 17 | 54.8% |
| 10 | ON | OFF | OFF | ON | OFF | 18 | 58.1% |
| 11 | ON | OFF | ON | OFF | OFF | 20 | 64.5% |
| 12 | ON | OFF | ON | OFF | ON | 21 | 67.7% |
| 13 | ON | OFF | ON | ON | ON | 23 | 74.2% |
| 14 | ON | ON | OFF | ON | OFF | 26 | 83.9% |
| 15 | ON | ON | ON | ON | ON | 31 | 100.0% |

As indicated by Table 7, to apply energy corresponding to gradation levels, the MCU 10 sends first control data related to 51.6% energy at the first time, sends second control data related to 25.8% energy at the second time, sends third control data related to 12.9% energy at the third time, sends fourth control data related to 6.5% energy at the fourth time, and sends fifth control data related to 3.2% energy at the fifth time for each of the heating elements R.

For example, when the heating element R1 is to print an image of gradation level 4, energy of 38.7% needs to be applied. In this case, the MCU 10 sends the second control data and the third control data for the heating element R1 based on Table 7, and energy of 38.7% (25.8%+12.9%) is applied to the heating element R1.

Thus, energy corresponding to gradation levels can be applied to the heating elements R by transferring control data corresponding to different amounts of energy five times. With the method described above, the number of data transfer from the MCU 10 to the shift register 14 can be reduced and high-speed printing can be achieved.

As another example, when printing an image by using Table 2 with four gradation levels, energy corresponding to gradation levels can be applied to the respective heating elements R by setting an energy level table including 8 ($=2^3$) energy levels and transferring control data three times. As still another example, when printing an image by using Table 3 with 32 gradation levels, energy can be applied to the heating elements R by setting an energy level table including 64 ($=2^6$) energy levels and transferring control data six times.

Thus, when an image is to be printed based on a gradation table with $2^n$ gradation levels (n is an integer greater than or equal to 1), an energy level table with $2^m$ energy levels (m is an integer greater than n) is set based on the minimum energy difference between the gradation levels in the gradation table. The MCU 10 can apply energy corresponding to gradation levels to the heating elements R by transferring control data corresponding to different amounts of energy "m" times to the shift register 14.

Table 8 indicates an exemplary relationship between the number of times control data is transferred from the MCU 10 to the shift register 14 (transfer count) and the amount of energy (energy value).

TABLE 8

| | TRANSFER COUNT (NO. OF ENERGY LEVELS) | | | | | |
|---|---|---|---|---|---|---|
| | ONE ($2^1 = 2$ LEVELS) | TWO ($2^2 = 4$ LEVELS) | THREE ($2^3 = 8$ LEVELS) | FOUR ($2^4 = 16$ LEVELS) | FIVE ($2^5 = 32$ LEVELS) | SIX ($2^6 = 64$ LEVELS) |
| FIRST | 100.0% | 66.7% | 57.1% | 53.3% | 51.6% | 50.8% |
| SECOND | | 33.3% | 28.6% | 26.7% | 25.8% | 25.4% |
| THIRD | | | 14.3% | 13.3% | 12.9% | 12.7% |
| FOURTH | | | | 6.7% | 6.5% | 6.3% |
| FIFTH | | | | | 3.2% | 3.2% |
| SIXTH | | | | | | 1.6% |

An energy value $E_1$ indicated by the first control data is obtained by a formula (2) below.

$$E_1 = \frac{1}{2 - 2^{1-m}} \times 100 \tag{2}$$

Also, an energy value indicated by control data transferred at the second or subsequent time is one half (½) of the energy value indicated by control data transferred at the previous time. Thus, energy corresponding to gradation levels in a gradation table can be applied to the heating elements R by setting energy value and transferring the control data for each of the heating elements R.

When energy is applied to a large number of heating elements at the same time, the power consumption may increase. Therefore, the MCU 10 transfers control data separately for each printing block: heating elements R1-R160, heating elements R161-R320, heating elements R321-R480, and heating elements R481-R640.

Figure 9A:
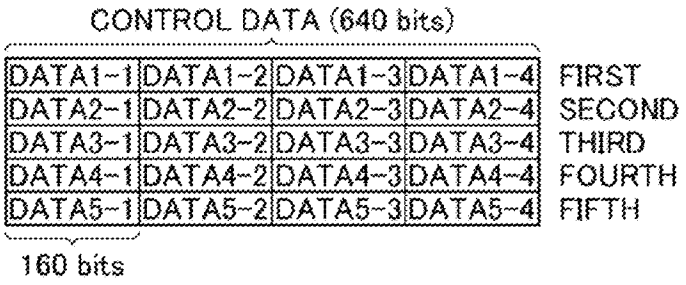
FIG. 9A is a drawing illustrating exemplary control data.

If transferring control data five times for each print line as illustrated by FIG. 9A, the MCU 10 generates five sets of 640-bit control data (DATA 1 through DATA 5) corresponding to the number of the heating elements. Then, the MCU 10 divides 640-bit control data into four sets of 160-bit control data (DATA N-1 through DATA N-4) corresponding to the printing blocks.

Figure 9B:
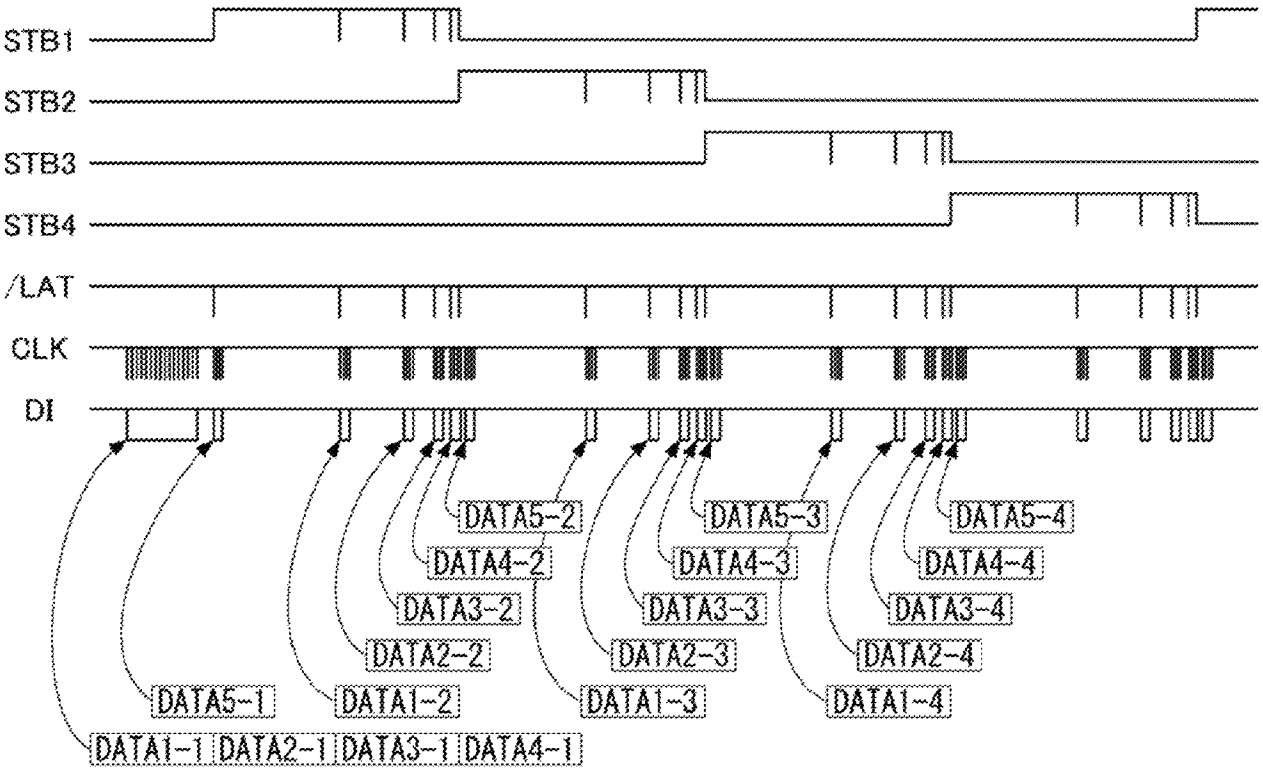
FIG. 9B is a timing chart illustrating a method of transferring control data.

As illustrated by FIG. 9B, the MCU 10 transfers first control data through fifth control data to the shift register 14 in sequence for each printing block. In FIG. 9B, the MCU 10 transfers control data DATA 1-1 through control data DATA 5-1 for the printing block of heating elements R1-R160 consecutively. Next, the MCU 10 transfers control data DATA 1-2 through control data DATA 5-2 for the printing block of heating elements R161-R320 consecutively. Then, the MCU 10 transfers control data DATA 1-3 through control data DATA 5-3 for the printing block of heating elements R321-R480 consecutively, and then transfers control data DATA 1-4 through control data DATA 5-4 for the printing block of heating elements R481-R640 consecutively. The control data transferred to the shift register 14 is transferred to the latch register 16 and then sent to the ICs corresponding to the heating elements R.

The MCU 10 also sends STB1 through STB4 signals in sequence to the ICs at the timing when power is supplied to the heating elements. As a result, power is supplied to each of the printing blocks. The power-supply period for which power is supplied to the heating elements R is controlled by a period in which the STB signal is on, to control the amount of energy applied to heating elements R. The input period of each STB signal is determined based on the control data such that the amount of energy set for each data transfer in Table 7 is applied to the corresponding heating elements. Thus, by transferring control data separately to each printing block and applying energy to heating elements, the number of heating elements to which power is supplied at the same time can be reduced to a maximum of 160, and the power consumption can be reduced.

Also, by transferring control data consecutively to each printing block, a time period from when supply of power to the heating element is ended to when supply of power to the heating element is started next time (power-supply interval) can be made constant, and variation in print density due to variation in the power-supply interval can be reduced.

<Energy Amount Correction>

Next, a method of correcting the amount of energy applied to the heating elements R is described.

Even when the same amount of energy is applied to heating elements, the density of a printed image may vary depending on the type of recording medium used. This is because the amount of energy necessary to produce color varies depending on recording media. Therefore, in the present embodiment, maximum values of energy applied (the amounts of energy at the maximum gradation level) to the heating elements R are set for different types of recording media. By setting different maximum energy values for different types of recording media, images with constant quality can be printed regardless of the types of recording media.

The RAM 11 stores an energy table exemplified by Table 9 where different maximum energy values $E_0(P)$ are set for respective types of paper P.

TABLE 9

| PAPER P | $E_0(P)$ [mJ/mm$^2$] |
|---|---|
| PAPER 1 | 23.7 |
| PAPER 2 | 28.9 |
| PAPER 3 | 22.9 |
| PAPER 4 | 32.4 |
| PAPER 5 | 31.4 |

For example, for paper 1, the energy $E_0$ applied to the heating elements R at the maximum gradation level is 23.7 mJ/mm$^2$. The MCU 10 obtains the maximum energy value $E_0$ (P) corresponding to the type of paper P used from the RAM 11. The type of paper P may be determined based on, for example, a parameter preset in the thermal printer 100, or a parameter received by the thermal printer 100 together with print data. Based on the obtained maximum energy value $E_0(P)$, the MCU 10 sends signals to the shift register 14 so that the amounts of energy set in a gradation table are applied to the heating elements R.

As described above, energy is applied separately to each printing block. Still however, when power is supplied to a large number of heating elements at the same time, a voltage drop may occur.

Figure 10:
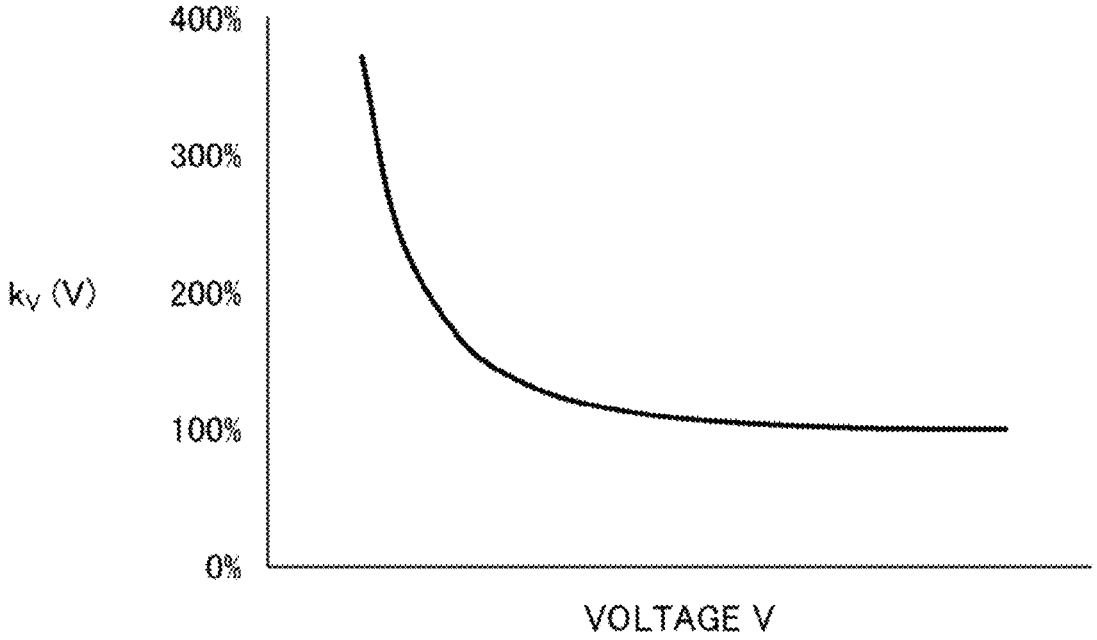
FIG. 10 is a graph illustrating a relationship between a supply voltage and a voltage correction value.

In the thermal printer 100, one or more voltage correction values $k_V$ (V) may be set and stored in the RAM 11 to correct the amount of energy applied to the heating elements R based on a voltage V applied by the power supply 17. FIG. 10 is a graph illustrating a relationship between the voltage V and the voltage correction value $k_V$ (V). The MCU 10 obtains a voltage correction value $k_V$ (V) corresponding to the voltage V from the RAM 11 to correct the amount of energy to be applied to the heating elements R.

As described above, the MCU 10 supplies power to heating elements by transferring control data multiple times for each print line. The number of heating elements to which power is supplied may vary each time control data is transferred, and a voltage drop may occur when power is supplied to a large number of heating elements at the same time. Therefore, the timing for correcting the amount of energy based on the voltage correction value $k_V$ (V) needs to be changed depending on the value of the voltage V. Because the amount of energy hardly varies in a high-voltage range, the amount of 100% energy can be corrected for each print line when the thermal printer is used with a high-voltage system. On the other hand, if a thermal printer is used with a low-voltage system such as a battery, the amount of energy to be supplied to the heating elements varies greatly depending on the voltage of the power source, and the amount of energy needs to be corrected based on the number of heating elements to which power is supplied. Accordingly, in this case, the amount of energy is corrected each time power is supplied.

Also, even when the same amount of energy is applied to a heating element each time, the temperature of the heating element after energy is applied may vary due to an influence of the temperature of the thermal head. Accordingly, even when image data with the same density is used, images with different density levels may be printed.

Figure 11:
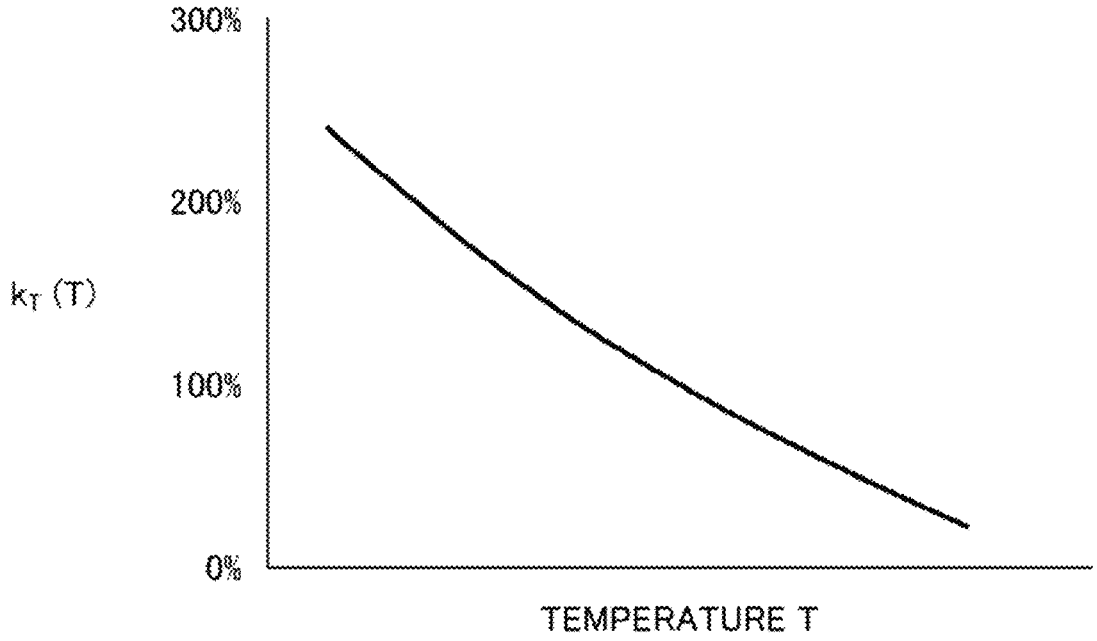
FIG. 11 is a graph illustrating a relationship between a temperature and a temperature correction value.

In the thermal printer 100, one or more temperature correction values $k_T$ (T) for correcting the amount of energy applied to the heating elements R based on a temperature T measured by the thermistor 12 can be set and stored in the RAM 11. FIG. 11 is a graph illustrating a relationship between the temperature T of the thermal head and the temperature correction value $k_T$ (T). The temperature correction value $k_T$ (T) is set at a small value in a high-temperature range and increases as the temperature T decreases. The MCU 10 obtains a temperature correction value $k_T$ (T) corresponding to the measured temperature T from the RAM 11, and corrects the amount of 100% energy to be applied to the heating elements R based on the temperature correction value $k_T$ (T). Although the temperature of the heating elements R increases each time power is supplied, the temperature of the heating elements R may not sharply increase. Therefore, correction of the amount of energy based on the temperature correction value $k_T$ (T) may be performed at any given timing, e.g., at 1-ms intervals.

Also, even when the same amount of energy is applied to a heating element each time, the temperature of the heating element may vary because the degree to which the heating element radiates heat and cools varies depending on a period of time from when supply of power for the previous print line ends to when supply of power for the next print line is started (radiation time t).

Figure 12:
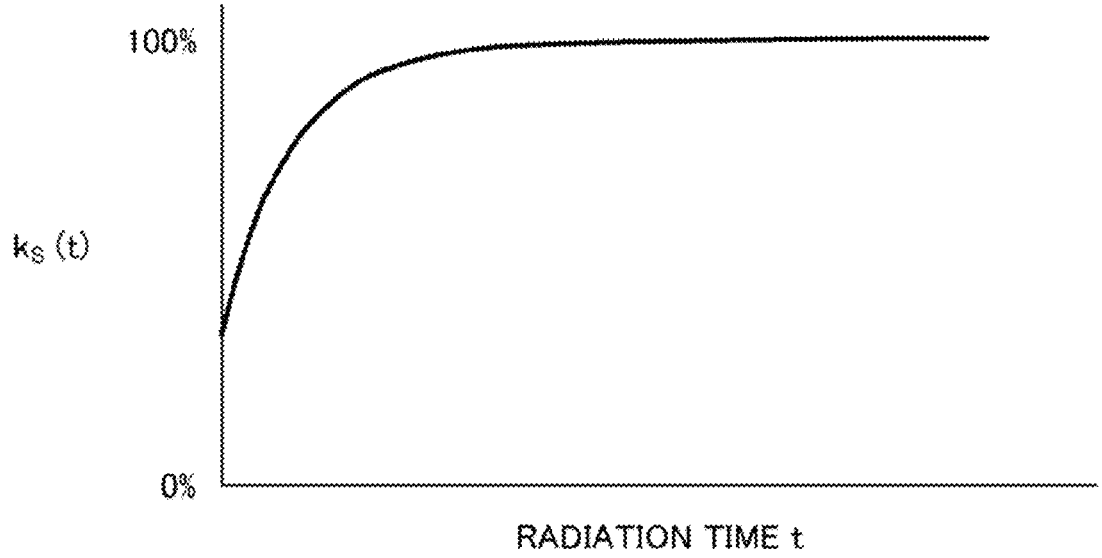
FIG. 12 is a graph illustrating a relationship between a radiation time and a speed correction value.

In the thermal printer 100, one or more rate correction values $k_S$ (t) for correcting the amounts of energy applied to the heating elements R based on the radiation time t of the heating elements R may be set and stored in the RAM 11. FIG. 12 is a graph illustrating a relationship between the radiation time t and the rate correction value $k_S$ (t). The rate correction value $k_S$ (t) becomes smaller as the radiation time t decreases. The MCU 10 obtains, for each print line, a rate correction value $k_S$ (t) corresponding to the radiation time t from the RAM 11 and corrects the amount of 100% energy to be applied to the heating elements R.

Further, the temperature of the heating element may vary depending on whether power is supplied at the previous print line and/or whether power is supplied to an adjacent heating element even if the same amount of energy is applied.

Figure 13:
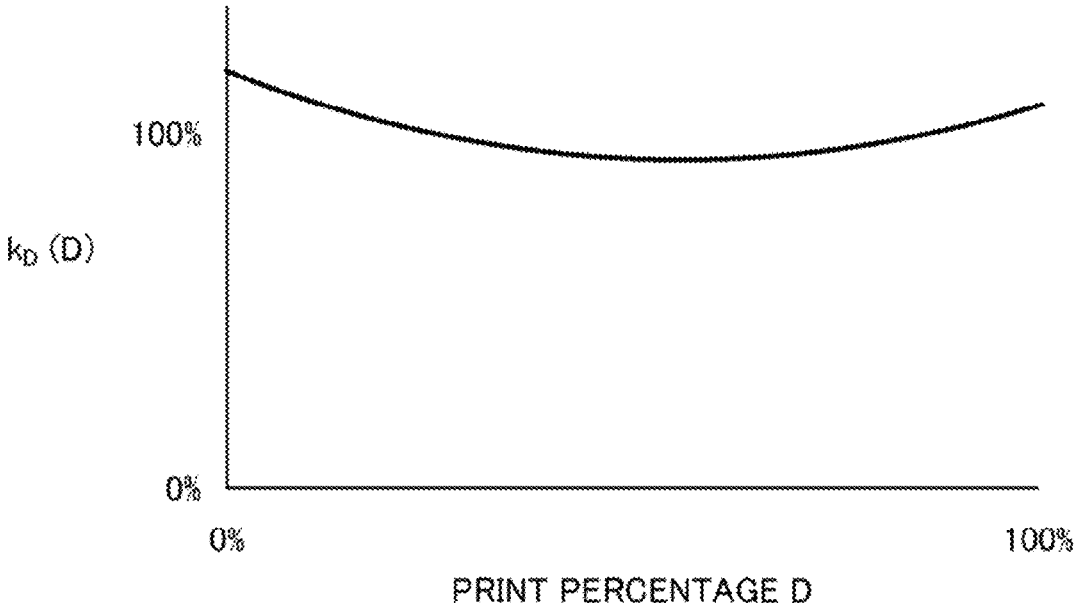
FIG. 13 is a graph illustrating a relationship between a print percentage and a print percentage correction value.

In the thermal printer 100, one or more percentage correction values $k_D$(D) for correcting the amount of energy applied to the heating elements R based on a print percentage D may be set and stored in the RAM 11 in association with print percentages D. FIG. 13 is a graph illustrating a relationship between the print percentage D and the percentage correction value $k_D$(D). The MCU 10 obtains a percentage correction value $k_D$(D) corresponding to a print percentage D from the RAM 11 to correct the amount of energy to be applied.

Figure 14:
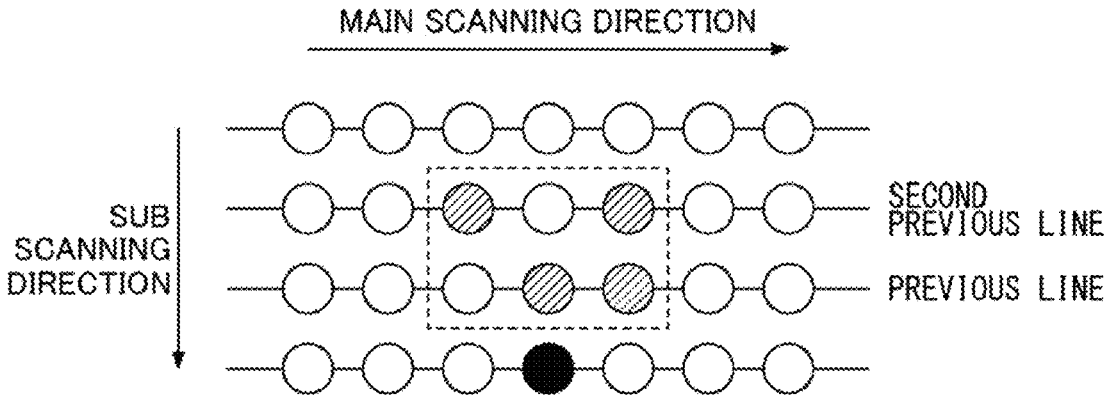
FIG. 14 is a drawing illustrating an exemplary method of calculating a print percentage.

For example, as illustrated by FIG. 14, the print percentage D is calculated based on six dots that are surrounded by a broken line. The six dots are in two previous lines that immediately precede, in the sub scanning direction, a line where a print dot indicated by a black circle exists. The print dot corresponds to one of the heating elements R. Two dots among the six dots are at the same position as the print dot in the main scanning direction, and four other dots are adjacent to these two dots. In FIG. 14, hatched circles indicate printed dots, and white circles indicate non-printed dots in which power is not supplied to the corresponding heating elements. In this example, as four of the six dots surrounded by the broken line are printed, the print percentage D is $4/6\times100=66.7\%$.

The MCU 10 obtains a percentage correction value $k_D$ (D) for each print dot from the RAM 11 based on the calculated print percentage D to correct the amount of energy to be applied to the heating element corresponding to the print dot. The method of calculating the print percentage D is not limited to the above described method.

As described above, in the present embodiment, the amount of energy applied to the heating elements R is corrected based on at least one of the voltage correction value $k_V$ (V), the temperature correction value $k_T$ (T), the rate correction value $k_S$ (t), and the percentage correction value $k_D$ (D). By correcting the amount of energy applied to the heating elements R, images with constant quality can be printed.

<Printing Process>

Next, an image data process and a printing process performed by the thermal printer 100 are described.

Figure 15:
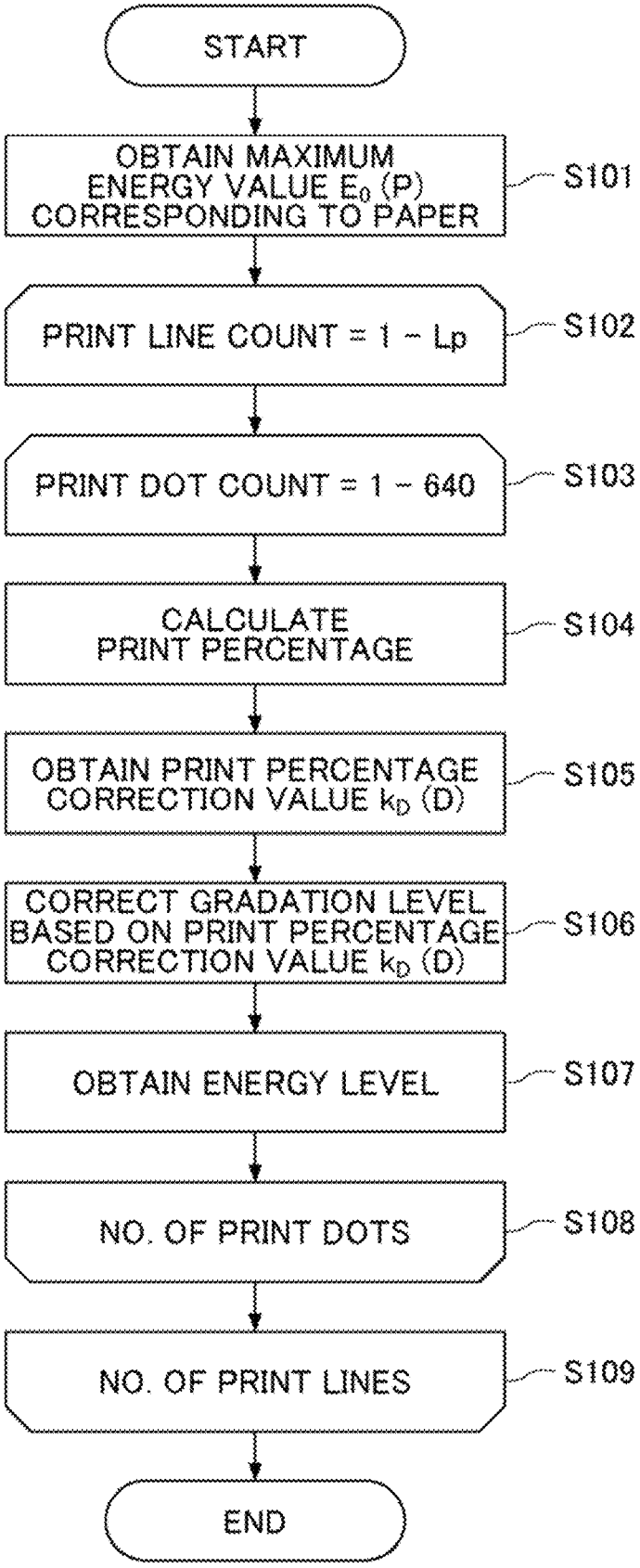
FIG. 15 is a flowchart illustrating an exemplary image data process.

FIG. 15 is a flowchart illustrating an exemplary image data process. When image data is input to the thermal printer 100, a process illustrated by FIG. 15 is performed.

At step S101, the MCU 10 obtains a maximum energy value $E_0$ (P) corresponding to the type of paper used for printing from the energy table (Table 9) stored in the RAM 11. Next, the MCU 10 repeats steps S102 through S109 for the number of print lines (print line count Lp) in the image data.

The MCU 10 repeats steps S103 through S108 for the number of print dots (print dot count) in each print line. In present embodiment, each print line includes 640 dots, and steps S103 through S108 are repeated 640 times for each print line, to calculate values for the respective dots. However, when such calculation is not necessary, repetition of those steps may be omitted.

At step S104, the MCU 10 calculates, for the corresponding print dot or heating element, a print percentage D of two print lines immediately preceding the print dot. Next, at step S105, the MCU 10 obtains a percentage correction value $k_D(D)$ corresponding to the calculated print percentage D from the RAM 11.

At step S106, the MCU 10 corrects the gradation level of the print dot based on the percentage correction value $k_D$ (D) obtained at step S105. For example, when the gradation level of the print dot is 9 and the percentage correction value $k_D(D)$ is 110%, the MCU 10 corrects the gradation level of the print dot to 10 (≈9×1.1).

At step S107, the MCU 10 obtains an energy level corresponding to the gradation level corrected at step S106 from Table 6 stored in the RAM 11, and associating gradation levels with energy levels. If the corrected gradation level is 10, the MCU 10 obtains an energy level 18.

In the process described above, steps S104 through S107 are performed for each dot in each print line and steps S103 through S108 are performed for each print line to obtain energy levels for all print dots in the image data to be printed.

Figure 16:
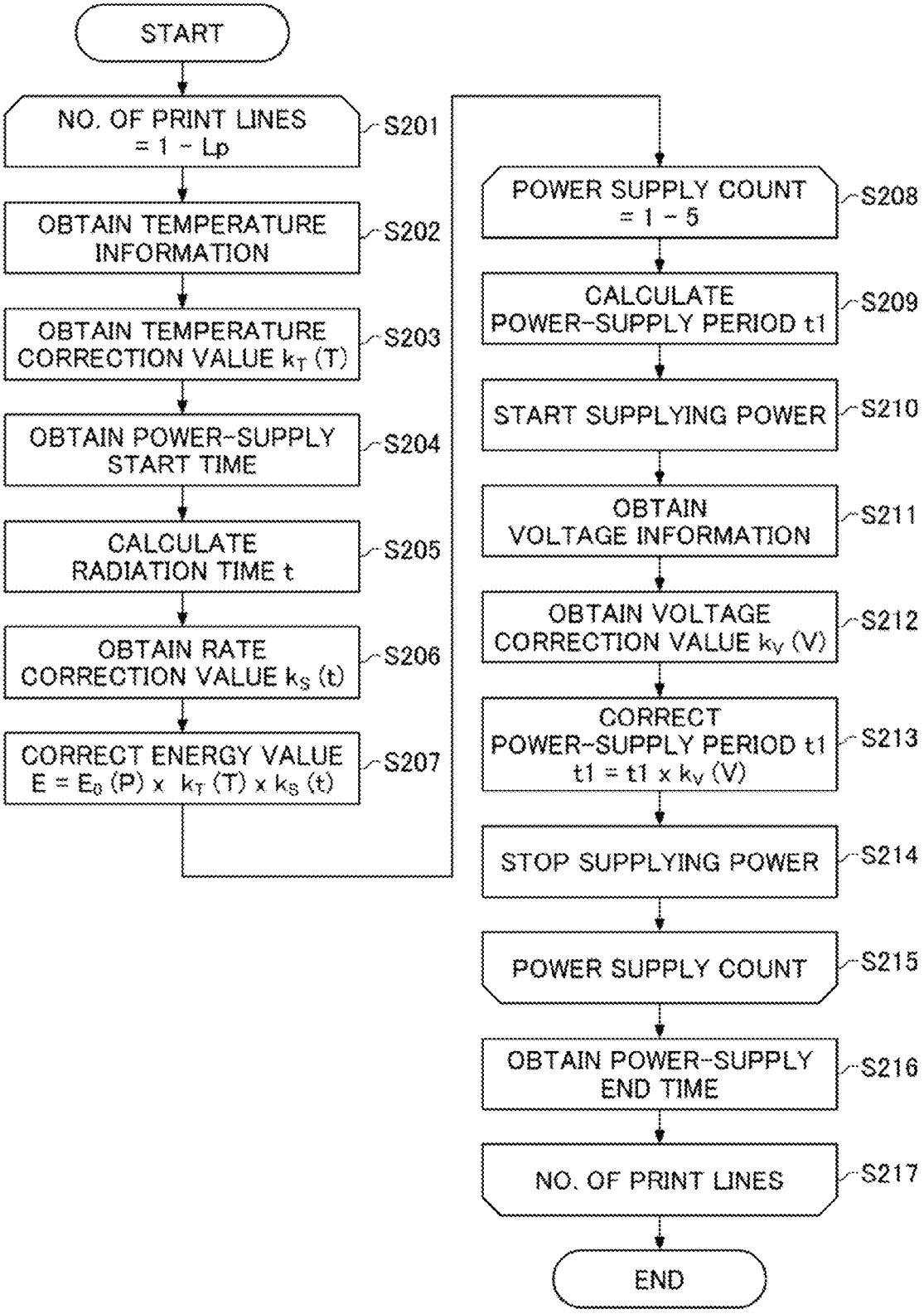
FIG. 16 is a flowchart illustrating an exemplary printing process.
Figure 17:
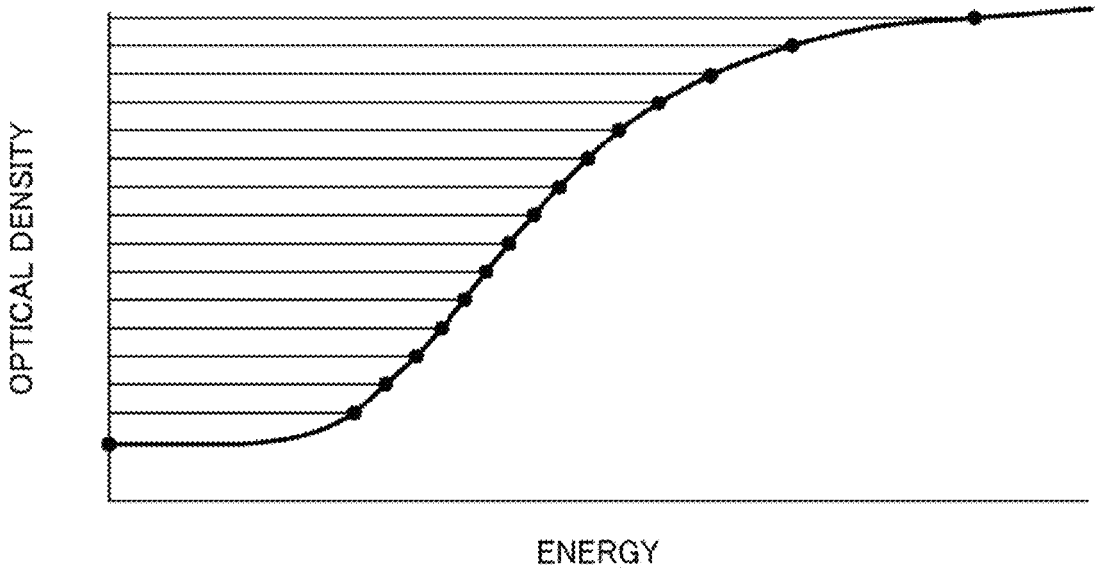
FIG. 17 is a graph illustrating a relationship between optical density of an image and energy applied to heating elements.
Figure 18:
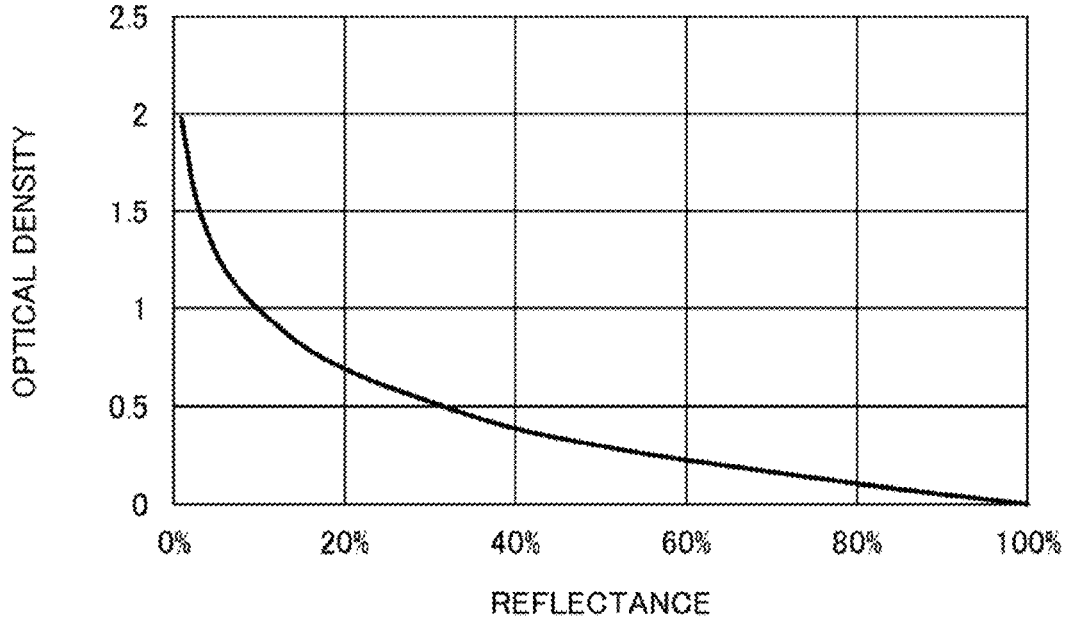
FIG. 18 is a graph illustrating a relationship between optical density and a reflectance of an image.
Figure 19A:
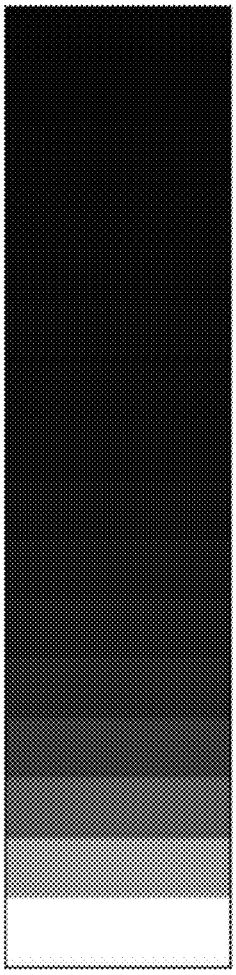
FIGS. 19A and 19B are examples of printed images according to the related-art.
Figure 19B:
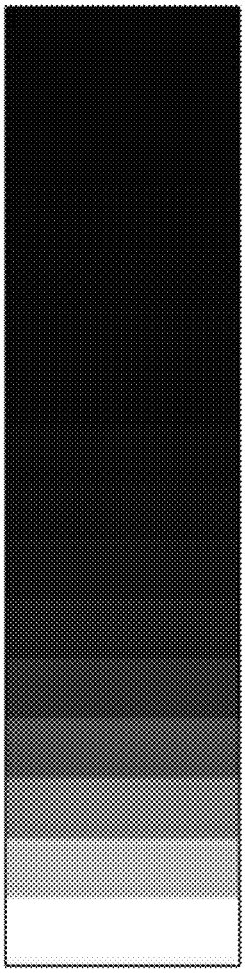

FIG. 16 is a flowchart illustrating an exemplary printing process. When image data is input to the thermal printer 100, the MCU 10 performs a process illustrated by FIG. 16 after performing the process of FIG. 15. In FIG. 16, steps S201 through S217 are repeated for the number of print line count Lp.

At step S202, the MCU 10 obtains a temperature T of the thermal head from the thermistor 12. Next, at step S203, the MCU 10 obtains a temperature correction value $k_T$ (T) corresponding to the obtained temperature T from the RAM 11.

At step S204, the MCU 10 obtains a power-supply start time. At step S205, the MCU 10 calculates a radiation time t from a power-supply end time of a previous print line to the power-supply start time obtained at step S204. Next, at step S206, the MCU 10 obtains a rate correction value $k_S$ (t) corresponding to the calculated radiation time t from the RAM 11.

At step S207, the MCU 10 corrects the maximum energy value $E_0$ (P) obtained at step S101 based on the temperature correction value $k_T$ (T) and the rate correction value $k_S$ (t) according to a formula (3) to obtain a corrected maximum energy value E to be applied to the heating elements R, and converts the corrected maximum energy value E into a power-supply period.

$$E=E_0(P)\times k_T(T)\times k_S(t) \quad (3)$$

Next, the MCU 10 repeats steps S208 through S215 for the number of times power is supplied to the heating elements R (power supply count). In FIG. 16, the power supply count per print line is five.

At step S209, the MCU 10 calculates a power-supply period t1 corresponding to the amount of energy to be supplied to heating elements. When the power supply count is five as indicated by Table 7, the MCU 10 calculates the power-supply period t1 such that an amount of energy corresponding to 51.6% of the corrected maximum energy value E obtained at step S207 is applied to heating elements at the first time. For the second and subsequent times, the MPU 10 calculates the power-supply period t1 such that amounts of energy corresponding to 25.8%, 12.9%, 6.5%, and 3.2% of the corrected maximum energy value E are applied sequentially to heating elements. The power-supply period t1 is controlled by changing the period for which the STB signal is turned on.

At step S210, the MCU 10 starts supplying power to the heating elements. At step S211, the MCU 10 obtains a voltage V being supplied from the power supply 17 to the heating elements.

At step S212, the MCU 10 obtains a voltage correction value $k_V$ (V) corresponding to the obtained voltage V from the RAM 11. At step S213, the MCU 10 corrects the power-supply period t1 calculated at step S209 based on the obtained voltage correction value $k_V$ (V) according to a formula (4) below.

$$t1=t1\times k_V(V) \quad (4)$$

At step S214, the MCU 10 stops supplying power to the heating elements when the corrected power-supply period t1 passes after the power supply is started. The power-supply period t1 corresponds to a length of time for which the STB signal is turned on. The MCU 10 controls the power-supply period t1 for each time so that the amounts of energy indicated by energy levels corresponding to gradation levels of image data are applied to the corresponding heating elements R.

When the power is supplied to the heating elements for the predetermined number of times (power-supply count) and printing of one print line is completed, the MCU 10 obtains a power-supply end time at step S216. The MCU 10 calculates a radiation time t for the next print line at step S205 based on the obtained power-supply end time.

Steps S201 through S217 described above are repeated for the number of print line count Lp until the printing of the image data is completed.

Thus, when image data is input, the thermal printer 100 processes the image data and then prints an image on a recording medium as described above.

As described above, in the thermal printer 100 of the present embodiment, the amount of energy to be applied to each heating element is set based on a dot area ratio to improve the gradation reproducibility of a printed image. Also in the present embodiment, the number of times control data is transferred by the MCU 10 is reduced so that a high-resolution image can be printed at a high speed. Further, the amount of energy to be applied to heating elements is corrected based on at least one of the voltage V applied by the power supply to the heating elements, the temperature T of the thermal head, the radiation time t, and the percentage D so that images with constant quality can be printed regardless of changes in various conditions.

A thermal printer according to the embodiment is described above. However, the present invention is not limited to the specifically disclosed embodiment, and variations and modifications may be made without departing from the scope of the present invention.

What is claimed is:

1. A thermal printer, comprising:

heating elements each of which generates heat according to an amount of energy applied thereto;

an energy applier that applies energy to each of the heating elements;

a memory that stores a gradation table where energy values are set for gradation levels based on a relationship between reflectances of a printed image and amounts of energy applied to the heating elements; and a controller that transfers control data corresponding to gradation levels of image data to the energy applier based on the gradation table to control the amounts of energy to be applied by the energy applier to each of the heating elements.

2. The thermal printer as claimed in claim 1, wherein the gradation table includes 2n gradation levels (n is an integer greater than or equal to 1);

the memory further stores an energy level table that includes energy levels obtained by dividing an energy range into 2m equal parts (m is an integer greater than n) based on a minimum difference between the energy values set for the gradation levels in the gradation table; and based on the energy levels, the controller transfers the control data m times such that m sets of the transferred control data correspond to different amounts of energy, to cause the energy applier to apply the amounts of energy corresponding to the gradation levels of the image data to the heating elements.

3. The thermal printer as claimed in claim 1, wherein the memory further stores an energy table defining medium-associated energy values corresponding to different types of recording media; and the controller obtains one of the medium-associated energy values based on a recording medium on which the image data is to be printed, and determines the energy values of energy to be applied by the energy applier to the heating elements based on the obtained one of the medium-associated energy values.

4. The thermal printer as claimed in claim 1, further comprising:

a temperature detector that detects a temperature of the heating elements, wherein the controller corrects the amounts of energy to be applied to the heating elements based on the detected temperature of the heating elements.

5. The thermal printer as claimed in claim 1, wherein the controller corrects the amounts of energy to be applied to the heating elements based on a radiation time from when supply of power for a previous print line ends to when supply of power for a next print line starts.

6. The thermal printer as claimed in claim 1, wherein the controller corrects the amount of energy to be applied to each heating element based on a print percentage of dots including a dot that is at a same position in a main scanning direction as a print dot corresponding to the heating element and in a previous print line immediately preceding a print line where the print dot exists.

7. The thermal printer as claimed in claim 1, wherein in the gradation table stored in the memory, the energy values are set for the gradation levels such that differences between the reflectances corresponding to adjacent pairs of the gradation levels become constant.

8. The thermal printer as claimed in claim 1, wherein in the gradation table stored in the memory, the gradation levels are set based on a relationship between the amounts of energy applied to the heating elements and dot area ratios of the printed image such that differences between the dot area ratios corresponding to adjacent pairs of the gradation levels become constant.

* * * * *